US006354276B1

(12) United States Patent
Toiyama et al.

(10) Patent No.: US 6,354,276 B1
(45) Date of Patent: Mar. 12, 2002

(54) ADJUSTING METHOD OF FUEL INJECTION SYSTEM

(75) Inventors: Seigi Toiyama, Oakazaki; Masahide Yamaguchi, Gamagori; Koji Mizukusa, Chita-gun; Nobutoshi Inatsugi, Kariya, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/684,934

(22) Filed: Oct. 6, 2000

(30) Foreign Application Priority Data

Oct. 8, 1999 (JP) ..... 11-288233

(51) Int. Cl.[7] ..... F02M 51/00
(52) U.S. Cl. ..... 123/490; 123/472; 137/487.5
(58) Field of Search ..... 123/472, 490; 137/12, 487.5

(56) References Cited

U.S. PATENT DOCUMENTS 5,048,489 A * 9/1991 Fischer et al. ..... 123/467
5,575,264 A * 11/1996 Barron ..... 123/486
6,016,832 A * 1/2000 Vars et al. ..... 137/487.5
6,155,233 A * 12/2000 Wade et al. ..... 137/487.5

* cited by examiner

*Primary Examiner*—Thomas N. Moulis
(74) *Attorney, Agent, or Firm*—Nixon & Vanderhye P.C.

(57) ABSTRACT

An adjusting pipe is being inserted into a housing while increasing an electric current frequency for a coil to control a fluid flow amount being constant. Since the electric current frequency is increased while keeping the fluid flow amount constantly, there is no need to wait until the flow amount becomes stable. Since both an insertion amount of the adjusting pipe and the frequency of the electric current supplied into the coil are simultaneously, continuously, and dynamically changed and adjusted, an adjusting time thereof is reduced.

6 Claims, 3 Drawing Sheets

ADJUSTING METHOD OF FUEL INJECTION SYSTEM

CROSS REFERENCE TO RELATED APPLICATION

This application is based on and incorporates herein by reference Japanese Patent Application No. Hei. 11-288233 filed on Oct. 8, 1999.

BACKGROUND OF THE INVENTION

1. Field of the Invention:

The present invention relates to a method for adjusting an insertion amount of an adjusting pipe for a fuel injection valve.

2. Description of Related Art

A conventional method for adjusting an insertion amount of an adjusting pipe 15 will be described with reference to FIGS. 1 and 3.

A frequency, a pulse duration, a pulse amplitude of an electric current supplied into a coil 15 are fixed at predetermined amounts. An injection amount per valve stroke, of each sample fuel injection valve, in accordance with the predetermined electric current is different from each other. Since the frequency of the electric current is fixed, when the injection amount is defined, a flow amount per unit time in accordance with the electric current is also defined. In this prior art, the insertion amount of the adjusting pipe is adjusted by supplying the fixed electric current having a constant frequency, a constant pulse durability, and a constant pulse amplitude into the fuel injection valve 10, and inserting the adjusting pipe 15 a housing 11 to change the injection amount until the flow amount reaches a target flow amount.

A back pressure valve 24 regulates the pressure of fluid flowing into the fuel injection valve 10 from a pump 20. Next, a motor 30 rotates to insert the adjusting pipe 15 to a predetermined position where a spring 14 generates a spring force to urge a needle 12 to reach a valve seat 11*a*.

A personal computer 40 receives a flow amount signal from a flow meter 23 and calculates the fluid flow amount per unit time. Since the insertion amount of the adjusting pipe 15 is small and the spring force of the spring 14 are small, the flow amount calculated by the personal computer 40 is larger than target flow amount.

An insertion amount is attained based on a relation map of the insertion amount and a difference between the calculated flow amount and the target flow amount. The relation map is previously memorized in a ROM of the personal computer 40. The relation map differs in accordance with the specificity of each 20 fuel injection valve.

The personal computer 40 controls a driving circuit 41 to supply an electric current based on the attained insertion amount into the motor 30. The motor 30 rotates to insert the adjusting pipe 15 into the housing 11 through an insertion screw 30.

The adjusting pipe 15 is inserted into the housing 11 to increase a valve opening period and decrease a valve closing period of the fuel injection valve 10, so that the injection amount is reduced, thereby reducing the fluid flow amount. Here, since a fluid flow becomes unstable due to the flow amount reduction, it is necessary to wait until the flow amount becomes stable to be constant to calculate a flow amount at this time based on a flow amount signal from the flow meter 23. When the calculated flow amount becomes within standard range from the target flow amount, the insertion amount adjusting procedure is finished. If the calculated flow amount is out of the standard range, the above described adjusting cycle is repeated until the calculated flow amount becomes within standard range from the target flow amount.

However, according to the above described conventional adjusting procedure, since the flow amount is reduced due to the insertion of the adjusting pipe 15, it is necessary to wait until the flow amount becomes stable to be constant to calculate a flow amount at the time when the insertion of the adjusting pipe 15 is completed, thereby increasing a total adjusting time.

Further, since the adjusting pipe 15 is press inserted into the housing 11, the adjusting pipe 15 cannot return to the previous position thereof when the adjusting pipe 15 is excessively inserted into the housing 11. Thus, the one cycle insertion amount based on the relation map is determined smaller than an insertion amount attaining the target flow amount, for preventing the adjusting pipe 15 from inserting excessively. Thus, it is difficult to adjust the insertion amount accurately with respect to an optimum insertion amount that can attain the target flow amount. As a result, even final flow amount attained by repeat of the insertion amount adjusting procedure must be larger than the target flow amount although it is within the standard range from the target flow amount, so that it is difficult to attain the target flow amount accurately.

SUMMARY OF THE INVENTION

An object of the present invention is to reduce a time for adjusting an insertion amount of an adjusting pipe, and to adjust the insertion amount accurately.

According to a first aspect of the present invention, an adjusting pipe is being inserted while changing an electric current for a coil to keep a flow amount of a fluid at a predetermined flow amount constantly. When the electric current supplied into the coil becomes a target electric current, the adjusting pipe is stopped being inserted, and the electric current is stopped being changed. That is, since the insertion amount of the adjusting pipe and the electric current are continuously adjusted and changed while keeping the flow amount constantly, there is no need to wait until the flow amount becomes stable as in the conventional adjusting method in which a fluid flow amount is decreased toward a target flow amount. Thus, the adjusting time is reduced.

Further, since the insertion amount of the adjusting pipe is adjusted while keeping the flow amount at the target flow amount, the insertion amount is accurately adjusted. Thus, the flow amount and an injection amount are highly accurately adjusted within the standard range from the target flow amount.

The adjusting method of the first aspect of the present invention is attained by merely changing a control program of a conventional adjusting system, so that there is no need to prepare an additional adjusting system.

According to a second aspect of the present invention, the electric current is changed by adjusting a frequency or a pulse duration thereof. An adjustment of the frequency or the pulse duration is easily done by a microprocessor or the like.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF PREFERRED EMBODIMENTS

First Embodiment

Figure 1:
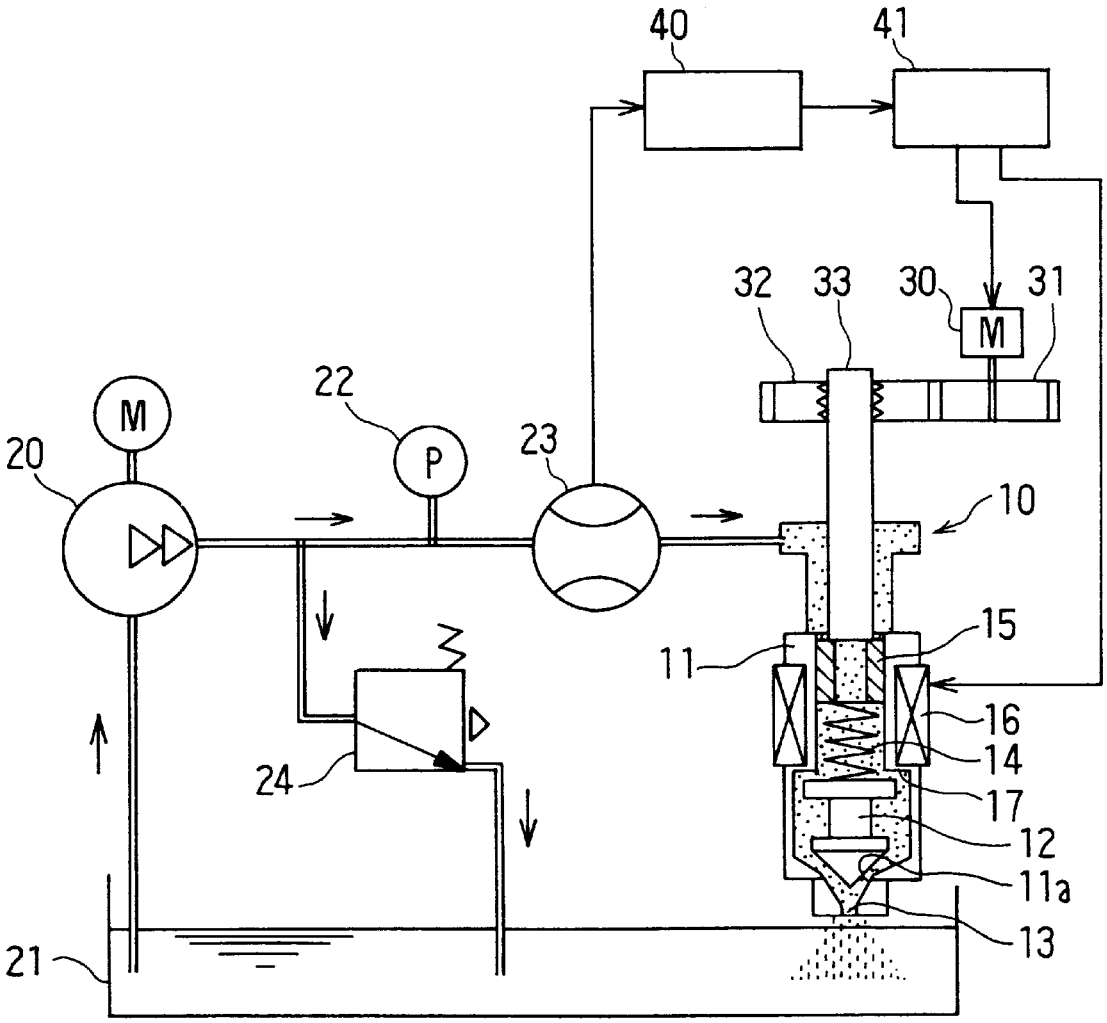
FIG. 1 is a schematic view showing a fundamental system to adjust an insertion amount of an adjusting pipe of a fuel injection valve.

FIG. 1 shows a fundamental system to adjust an insertion amount of an adjusting pipe 15 of a fuel injection valve 10. The fundamental system in the present embodiment is almost the same as in the prior art. The fuel injection valve 10 includes a housing 11, a valve seat 11*a*, a needle 12, a nozzle 13, a spring 14, an adjusting pipe 15, a coil 16, and a stopper 17. The fuel injection valve 10 injects a sample fluid when the needle 12 leaves the valve seat 11*a*. An incombustible fluid is used as the sample fluid having substantially same viscosity as the fuel. The spring 14 urges the needle 12 toward the valve seat 11*a*. That is, the spring 14 urges the needle 12 such that the needle 12 closes the nozzle 13. An insertion amount of the adjusting pipe 15 adjusts the spring force of the spring 14. The insertion amount of the adjusting pipe 15 is defined as a displacement from an initial position of the adjusting pipe 15 to a position where the adjusting pipe 15 is inserted. The adjusting pipe 15 is press inserted into the housing 11, and mechanically fixed to the housing 11 after the insertion amount thereof is determined. When an electric current is supplied into the coil 16, the coil 16 generates a magnetic force attracting the needle 12 upwardly against the spring force of the spring 14, so that the needle 12 leaves the valve seat 11*a*. The stopper 17 restricts the maximum lift amount of the needle 12.

A pump 20 suctions the sample fluid from a tank 21, and supplies it into the fuel injection valve 10. A pressure gage 22 detects the pressure of the sample fluid flowing through the fuel injection valve 10. A flow meter 23 detects the flow amount of the sample fluid flowing through the fuel injection valve 10. The flow meter 23 outputs the pulse number per unit time of a pulse signal generated in accordance with the fluid flow amount as a flow amount signal. The flow amount is in proportion to the pulse number. A back pressure valve 24 regulates the pressure of the sample fluid flowing into the fuel injection valve 10. The back pressure valve 24 may be replaced with a pressure reduction valve to regulate the fluid pressure. A motor gear 31 rotating with a motor 30 engages with a screw gear 32. The screw gear 32 engages with an insertion screw 33. When the screw gear 32 rotates, the insertion screw 33 moves upwardly or downwardly in FIG. 1. When the insertion screw 33 moves downwardly, the adjusting pipe 15 is inserted into the housing 11. A personal computer 40 receives the fluid flow amount signal from the flow meter 23 and calculates the fluid flow amount per unit time. A personal computer 40 controls a driving circuit 41 to adjust an electric current from the driving circuit 41 to the motor 30 and the coil 16.

When the insertion amount of the adjusting pipe 15 increases, the spring force of the spring 14 also increases. Thus, when a constant electric current, which has constant frequency, constant pulse duration, and constant pulse amplitude, is supplied into the coil 15, an opening valve period becomes long and a closing valve period becomes short in the fuel injection valve 10, so that a fluid injection amount per one valve stroke is reduced. Therefore, the fluid flow amount detected by the flow meter 23 is also reduced. Here, the opening valve period is defined as a period while the needle 12 leaves the valve seat 11*a* and reaches the stopper 17. The closing valve period is defined as a period while the needle 12 leaves the stopper 17 and reaches the valve seat 11*a*.

According to the present embodiment, the personal computer 40 controls the electric current being supplied into the motor 30 and the coil 16 to constantly keep a target fluid amount. The pulse duration and the pulse amplitude of the electric current being supplied into the coil 16 are controlled to be constant, while the frequency thereof is controlled to change. When the frequency of the electric current reaches a target frequency, the adjusting pipe insertion is stopped.

An adjusting method of the insertion amount of the adjusting pipe 15 will be explained with reference to FIG. 2.

The back pressure valve 24 regulates the pressure of the fluid flowing into the fuel injection valve 10 from the pump 20. Next, the motor 30 rotates to insert the adjusting pipe 15 to a predetermined position where the spring 14 generates a spring force to urge the needle 12 to reach the valve seat 11*a*.

Figure 2:
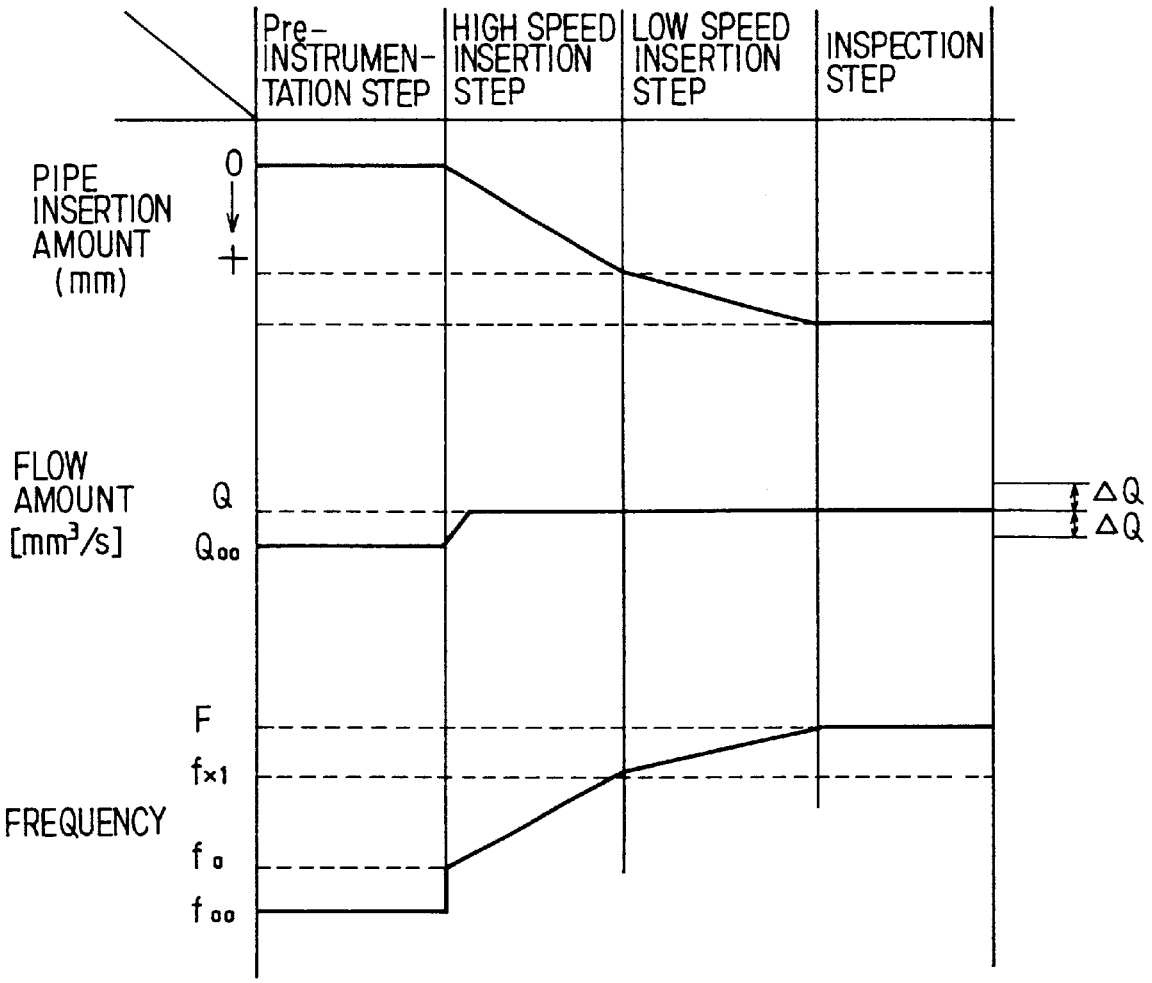
FIG. 2 is a graph showing a relation between the insertion amount of the adjusting pipe and an electric current frequency.
Figure 3:
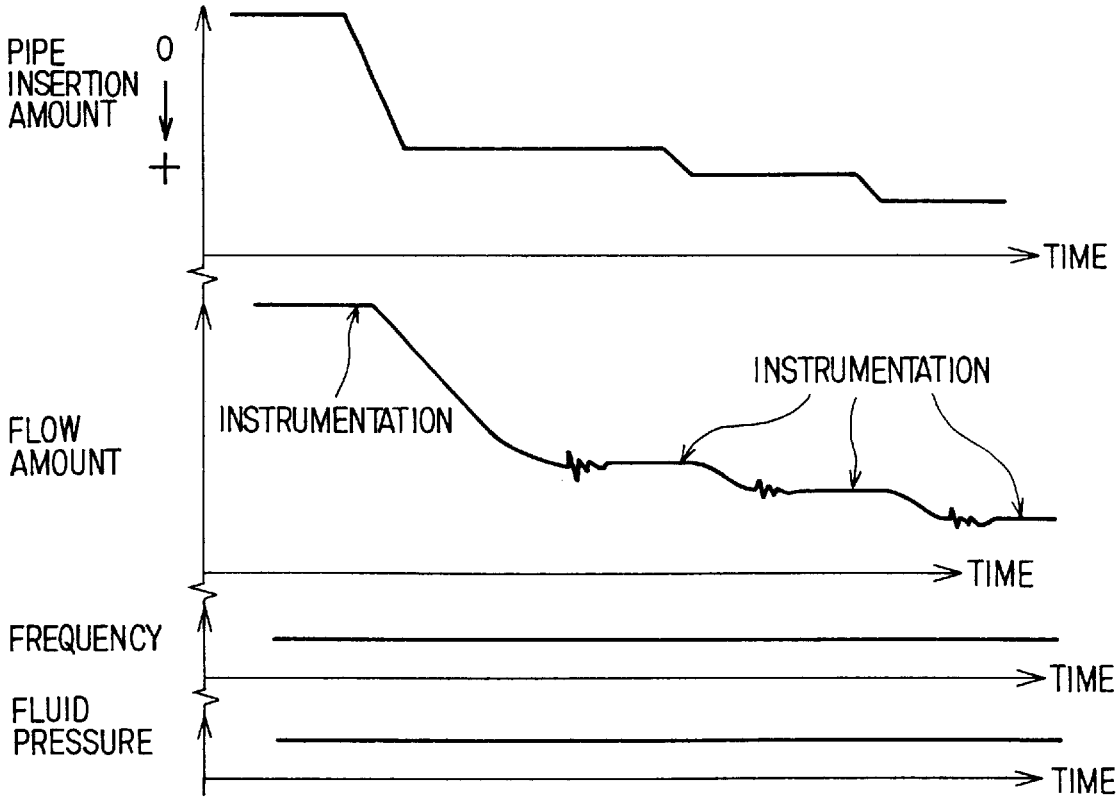
FIG. 3 PRIOR ART
FIG. 3 is a graph showing a relation between the insertion amount of the adjusting pipe and a fluid flow amount in the prior art.

During a pre-instrumentation step in FIG. 2, the electric current is not supplied into the motor 30, so that the adjusting pipe 15 is not inserted furthermore. An electric current having an initial frequency $f_{00}$ lower than a target frequency F is supplied into the coil 16. Under this condition, the personal computer 40 calculates a flow amount $Q_{00}$ [$mm^3$/sec] of the fluid flowing through the fuel injection valve 10 based on the flow amount signal from the flow meter 23. An injection amount per one valve stroke $q_{00}$[$mm^3$/str] at this time is $Q_{00}/f_{00}$. A target flow amount Q is q×F [$mm^3$/sec]. Here, q is a target injection amount.

For attaining the target flow amount Q (=q×F [$mm^3$/sec]) when the injection amount is $q_{00}$ [$mm^3$/str] based on the initial insertion amount of the adjusting pipe 15 during the pre-instrumentation step, a first frequency $f_0=Q/q_{00}$ is calculated. The personal computer 40 controls the driving circuit 41 to supply an electric current having the first frequency $f_0$ into the coil 16.

When the frequency of the electric current is changed from $f_{00}$ to $f_0$ without inserting the adjusting pipe further more, the fluid flow amount increases to the target flow mount Q [$mm^3$/sec].

Next, during a high-speed insertion step, an electric current is supplied into the motor 30 to insert the adjusting pipe 15 constantly, and the frequency of the electric current supplied into the coil 16 is increased by $\Delta f_i$ from the first frequency $f_0$ to keep the target flow amount Q. When a predetermined target frequency of the high-speed insertion step is $f_{x1}$, $\Delta f_i$ is $(f_{x1}-f_0)/50$. That is, the frequency becomes $f_{x1}$ by repeating to add $\Delta f_i$ fifty times. When the frequency of the electric current becomes $f_{x1}$ $(=f_0+\Sigma\Delta f_i)$, the high-speed insertion step is completed and a low-speed insertion step is started.

During the low-speed insertion step, the adjusting pipe 15 is continuously inserted by lower constant speed than that in the high-speed insertion step. A fluid flow amount $Q_m$ [$mm^3$/sec] is calculated by the personal computer 40 based on a flow amount signal from the flow meter 23 at a sampling timing. Here, a control to compensate the flow amount $Q_m$ to the target flow amount Q will be explained.

An injection amount $q_m$ at the sampling timing is calculated based on the flow amount $Q_m$ and a frequency $f_m$ at the sampling timing ($q_m=Q_m/f_m$).

A frequency $f_{x2}$ of electric current to be supplied with the coil 16 at next sampling timing is attained based on the Q and $q_m$ ($f_{x2}=Q/q_m$). That is, the frequency $f_{x2}$ is attained such that the flow amount becomes the target flow amount Q at a next sampling time under an assumption that the injection amount $q_m$ attained by $Q_m$ and $f_m$ is kept continuously.

The adjusting pipe 15 is continuously inserted into the housing 11 while changing a needle reciprocating frequency into $f_{x2}$. At the next sampling time, a next flow amount $Q_n$ is calculated, and $q_n$ is calculated based on $Q_n$ and $f_{x2}$.

The above-described control is repeated until the frequency $f_{x2}$ reaches the target frequency F.

When the frequency $f_{x2}$ reaches the target frequency F, the insertion of the adjusting pipe 15 and the frequency change are stopped simultaneously, and the low-speed insertion step is finished.

During inspection step, the fuel injection valve 10 is inspected whether an injection amount thereof due to the electric current having the target frequency F is within a standard range.

Here, during the low-speed insertion step, the adjusting pipe 15 is being continuously inserted into the housing 11, the calculated injection amount $q_m$ gradually decreases at each sampling timing. Thus, the calculated flow amount $Q_n$ ($=q_n \times f_{x2}$) after the predetermined sampling timing must be smaller than the target flow amount Q ($Q_n<Q=q_m \times f_{x2}$). Thus, the next calculated frequency $f_{x2}$ ($=Q/q_n$) is larger than the $f_m$ ($=Q_m/q_m$) Thus, the calculated frequency $f_{x2}$ gradually increases at every sampling timing, and gradually reaches the target frequency F.

As described above, according to the present embodiment, the adjusting pipe 15 is being inserted into the housing 11 while increasing the electric current frequency for the coil 16 to compensate a flow amount reduction due to the adjusting pipe insertion. Thus, the fluid flow amount, which is a product of injection amount and frequency, is controlled to be constant, and the adjusting pipe 15 is stopped being inserted when the frequency reaches the target frequency. Since a raising speed of the frequency can be increased and reduced not like a pipe insertion amount, the frequency is adjusted to increase toward the target frequency while keeping the flow amount constantly. In this way, since the frequency can be increased while keeping the flow amount constantly, there is no need to wait until the flow amount becomes stable as in the conventional adjusting procedure in the prior art. Further, since both the insertion amount of the adjusting pipe 15 and the frequency of the electric current supplied into the coil 16 are simultaneously, continuously, and dynamically changed and adjusted, an adjusting time thereof is reduced.

The adjusting method of the present embodiment is attained by merely changing the control program of the personal computer 40, so that there is no need to prepare an additional adjusting system.

Further, since the insertion amount of the adjusting pipe 15 is adjusted while keeping the flow amount at the target flow amount, the flow amount is highly accurately adjusted within the standard range from the target flow amount.

According to the present embodiment, the frequency of the electric current is changed to adjust the fluid flow amount. Alternatively, the pulse duration or pulse amplitude may be continuously changed to adjust an injection amount, while adjusting the insertion amount of the adjusting pipe 15.

What is claimed is:

1. A method for adjusting a fuel injection system, said fuel injection system including:

a fuel injection valve including a valve member and a nozzle, said valve member opening and closing said nozzle;

a spring means for urging said valve member toward a direction where said valve member closes said nozzle;

a coil attracting said valve member against an urging force of said spring means;

an adjusting pipe contacting said spring means and adjusting the urging force of said spring means;

a pump supplying a fluid into said fuel injection valve;

a pressure gage measuring a pressure of the fluid;

a flow meter measuring a flow amount of the fluid;

a pressure regulator regulating the pressure of the fluid;

a motor adjusting an insertion amount of said adjusting pipe; and a controller controlling to supply electric currents into said coil and said motor;

the method for adjusting the fuel injection system comprising:

controlling to supply the electric currents into said coil and said motor, for adjusting the insertion amount of said adjusting pipe and changing the electric current supplied into said coil such that the flow amount of the fluid is kept substantially constant, and adjusting the insertion amount of said adjusting pipe such that the electric current supplied into said coil becomes a target electric current.

2. A method for adjusting a fuel injection system according to claim 1 wherein the insertion amount of said adjusting pipe is adjusted such that the electric current becomes the target electric current having a target frequency.

3. A method for adjusting a fuel injection system according to claim 1 wherein the insertion amount of said adjusting pipe is adjusted such that the electric current becomes the target electric current having a target pulse duration.

4. A method for adjusting a fuel injection system, said fuel injection system including:

a fuel injection valve including a valve member and a nozzle, said valve member opening and closing said nozzle;

a spring means for urging said valve member toward a direction where said valve member closes said nozzle;

a coil attracting said valve member against an urging force of said spring means, and an adjusting pipe contacting said spring means and adjusting the urging force of said spring means;

said method for the adjusting the fuel system comprising:

controlling an insertion amount of said adjusting pipe to adjust an injection amount of the fluid per stroke of said valve member; and controlling a stroke frequency of said valve member, wherein the insertion amount of said adjusting pipe and the stroke frequency of said valve member are controlled based on a flow amount of the fluid, which is a product of the injection amount and the frequency, a target flow amount (Q) and a target stroke frequency (F) are previously determined, said adjusting pipe is continuously inserted to reduce the injection amount gradually, the stroke frequency is gradually increased from a first frequency ($f_0$) being smaller than the target frequency (F) to the target frequency (F), and a speed of an increase of the stroke frequency is controlled to make the flow amount of the fluid to reach the target flow amount (Q), and when the frequency reaches the target frequency (F), said adjusting pipe is stopped being inserted, and said the frequency is stopped being increased.

5. A method for adjusting a fuel injection system according to claim 4, wherein the frequency is increased at a sampling timing, when a flow amount of the fluid at the sampling time is $Q_m$, a frequency of the electric current at the sampling time is $f_x$, a frequency $f_{x2}$ of a next sampling time is attained by a following expression, $f_{x2}=Q\times f_x/Q_m$.

6. A method for adjusting a fuel injection system according to claim 5 wherein said adjusting pipe is constantly inserted.

* * * * *